US006600459B2

(12) United States Patent
Yokoshima et al.

(10) Patent No.: US 6,600,459 B2
(45) Date of Patent: Jul. 29, 2003

(54) ANTENNA

(75) Inventors: Takao Yokoshima, Tokyo (JP); Toshiyuki Chiba, Tokyo (JP); Shiro Sugimura, Kanazawa (JP); Hideki Kobayashi, Kanazawa (JP)

(73) Assignees: Mitsubishi Materials Corporation, Tokyo (JP); FEC Co., Ltd., Kanazawa (JP)

( * ) Notice: Subject to any disclaimer, the term of this patent is extended or adjusted under 35 U.S.C. 154(b) by 0 days.

(21) Appl. No.: 09/983,970

(22) Filed: Oct. 26, 2001

(65) Prior Publication Data

US 2002/0067316 A1 Jun. 6, 2002

(30) Foreign Application Priority Data

Oct. 27, 2000 (JP) ..... P2000-329559
Sep. 7, 2001 (JP) ..... P2001-272687

(51) Int. Cl.[7] ..... H01Q 1/36

(52) U.S. Cl. ..... 343/895; 343/700 MS; 343/702

(58) Field of Search ..... 343/702, 700 MS, 343/895, 873, 745, 749

(56) References Cited

U.S. PATENT DOCUMENTS

| | | | | |
|---|---|---|---|---|
| 2,648,771 A | | 8/1953 | Cork | |
| 4,644,366 A | | 2/1987 | Scholz | 343/895 |
| 4,706,050 A | * | 11/1987 | Andrews | 29/600 |
| 4,827,266 A | * | 5/1989 | Sato et al. | 343/700 MS |
| 5,696,517 A | * | 12/1997 | Kawahata et al. | 343/700 MS |
| 5,861,852 A | * | 1/1999 | Asakura et al. | 343/702 |
| 5,870,065 A | * | 2/1999 | Kanba et al. | 343/787 |
| 6,023,251 A | * | 2/2000 | Koo et al. | 343/700 MS |
| 6,034,640 A | * | 3/2000 | Oida et al. | 343/700 MS |
| 6,075,491 A | * | 6/2000 | Dakeya et al. | 343/700 MS |

FOREIGN PATENT DOCUMENTS

| | | |
|---|---|---|
| DE | 2629685 A1 | 5/1978 |
| EP | 0 878 864 | 11/1998 |
| EP | 1 096 601 | 5/2001 |
| EP | 1 178 561 | 2/2002 |
| GB | 2280789 | 2/1995 |
| JP | 5-15515 | 2/1993 |
| JP | 5-31323 | 4/1993 |
| JP | 7-297627 | 11/1995 |
| JP | 7-321550 | 12/1995 |
| JP | 8-51313 | 2/1996 |
| JP | 8-288739 | 11/1996 |
| JP | 9-98009 | 4/1997 |
| JP | 9-153734 | 6/1997 |
| JP | 9-219610 | 8/1997 |
| JP | 10-13138 | 1/1998 |
| JP | 10-13139 | 1/1998 |
| JP | 1032413 | 2/1998 |
| JP | 10-32413 | 2/1998 |
| JP | 10-32421 | 2/1998 |
| JP | 10-84218 | 3/1998 |
| JP | 10-107537 | 4/1998 |
| JP | 10-209733 | 8/1998 |
| JP | 10-256825 | 9/1998 |
| JP | 11-4113 | 1/1999 |
| JP | 11-55022 | 2/1999 |
| JP | 2001-196831 | 7/2001 |

* cited by examiner

*Primary Examiner*—Tan Ho
(74) *Attorney, Agent, or Firm*—Oblon, Spivak, McClelland, Maier & Neustadt, P.C.

(57) ABSTRACT

An antenna of a compact size enables to raise the inductance value of the resonance section and produce high gain. The antenna is constructed by connecting resonance sections and in series, in which each antenna element has an inductance section and a capacitance section connected electrically in parallel, and each inductance section has a conductor shaped in a square shape to circle the respective coil axes, and the opening sections formed at respective ends of the coil sections are contained in respective planes that are oriented at an angle to the coil axes.

8 Claims, 5 Drawing Sheets

ANTENNA

BACKGROUND OF THE INVENTION

1. Field of the Invention

The present invention relates to an antenna, particularly a compact antenna suitable for inclusion in various devices having capabilities for processing radio signals, including various communication devices that can transmit and receive radio signals.

2. Description of the Related Art

In recent years, there have been increasing uses for antennas that can be used in frequency bands in a range of several hundreds of MHz to several tens of GHz due to increasing demand for various devices having capabilities for transmitting and receiving radio signals, including various communication devices for processing radio signals. Obvious uses for such antennas include mobile communications, next generation traffic management systems, non-contacting type cards for automatic toll collection systems, but in addition, because of the trend toward the use of wireless data handling systems that enable to handle data, without using cumbersome lengthy cables, such as cordless operation of household appliances through the Internet, Intranet radio LAN, Bluetooth and the like, it is anticipated that the use of such antennas will also be widespread in similar fields. Furthermore, such antennas are used in various systems for wireless data handling from various terminals, and the demand is also increasing for applications in telemetering for monitoring information on water pipes, natural gas pipelines and other safety management systems and POS (point-of-sale) terminals in financial systems. Other applications are beginning to emerge over a wide field of commerce including household appliances such as TV that can be made portable by satellite broadcasting as well as vending machines.

To date, such antennas described above used in various devices having capabilities for receiving and transmitting radio signals are mainly monopole antennas attached to the casing of a device. Also known are helical antennas that protrude slightly to the exterior of the casing.

However, in the case of monopole antennas, it is necessary to extend the structure for each use of the device to make the operation cumbersome, and, there is a further problem that the extended portion is susceptible to breaking. Also, in the case of the helical antennas, because a hollow coil that serves as the antenna main body is embedded in a covering material such as polymer resin for protection, the size of device tends to increase if it is mounted on the outside the casing and it is difficult to avoid the problem that the aesthetics suffers. Nevertheless, reducing the size of the antenna leads only to lowering of signal gain, which inevitably leads to increasing the circuit size for processing radio signals to result in significantly higher power consumption and a need for increasing the size of the battery, and ultimately leading back to the problem that the overall size of the device cannot be reduced.

However, when attempts are made to realize a compact antenna comprised by a resonant circuit having an inductance section and a capacitance section, it is difficult to obtain sufficient inductance values, and even if a coil-shaped antenna is used, there is a problem that the area of the opening cannot be made large. For example, although a coil design is known that utilizes conductor patterns formed on front and back surfaces of a substrate plate, which are connected electrically via a through-hole, in this case, the coil opening area is limited by the dimensions of the thickness and width of the substrate plate. Naturally, by increasing the thickness and width of the substrate plate, the size of the opening area can be made larger, but this approach does not enable to reduce the antenna size. Also, increasing the number of winding of the coil naturally increases inductance values, but for high frequency applications, the conductor patterns must be separated to some extent, such that increasing the number of windings leads to lengthening the antenna.

SUMMARY OF THE INVENTION

The present invention is provided in view of the background information described above, and an object is to provide a compact antenna that enables to raise the inductance values of the resonant section and to obtain high gain.

A first embodiment of the present invention relates to an antenna comprising a resonance section having an inductance section and a capacitance section connected electrically in parallel; wherein the inductance section has a coil section comprised by a conductor formed in a spiral shape circling a coil axis or an angular shape that can be approximated by a spiral circling the coil axis, and at least one opening section of opening sections formed at both ends of the coil section is contained in a plane oriented at an angle to the coil axis.

By having such a structure, the area of the opening section is increased and at the same time, the magnetic flux penetrating through the opening section is also increased, such that inductance values of the coil section is increased.

The conductor is formed by linking the portion that circles the coil axis in plurality in the direction of the coil axis. If cylindrical coordinates are used to designate the coil axis as z-axis, and describe the position of each section of the conductor, a typical spiral exhibits monotonic changes in the z-coordinate as the angular coordinate $\theta$ is varied. Then, consider a spiral conductor that circles the coil axis over an angular displacement of $\theta$=360 degrees, and one plane intersecting the z-axis at right angles at the starting point and another plane intersecting the z-axis at the ending point of such a spiral, then this spiral does not intersect the planes except at the beginning point and at the ending point of the conductor spiral. If one supposes such a plane for each complete revolution (or turning portion) of the conductor spiral, then the conductor is divided by a series of such planes at right angles to the coil axis. When this argument is extended to a general spiral-like conductor or a conductor that can be approximated by a spiral, a group of such planes can be visualized to divide the conductor but the turning portions (loops) of the conductor do not intersect the planes except at the beginning points and the ending points of each loop. Then, the portion that circles the coil axis of the conductor can be associated with an adjacent imaginary plane that separates the portion, so that an expression "the portion that circles the coil axis is substantially contained within the imaginary plane that divides the conductor" is used. (herein below imaginary planes that divide the conductor are referred to simply as planes). The opening sections formed at both ends of the coil section is comprised by the portion that circles the coil axis, and the opening section is substantially contained within the plane that substantially contains the portion circling the coil axis.

It can be seen that, when the opening section is contained within the plane oriented at an angle to the coil axis, the orientation of the magnetic field produced by the current flowing in this portion of the coil is generated substantially at right angles to the coil axis. The magnetic flux that penetrates this inclined plane is higher than a case of similar magnetic flux that penetrate a plane at right angles to the coil axis. It thus follows that the inductance value of the coil section is increased.

In this case, it is preferable that respective portions of the conductor that circle the coil axes are provided parallel to the opening section contained in a plane oriented at an angle to the coil axis. By adopting this structure, the magnetic flux penetrating the plane that includes the portion circling the coil axis of the conductor is also increased, and the inductance values are further increased.

Also, it is preferable that the antenna has a plurality of resonance sections, and the resonance sections are connected electrically in series. By adopting this structure, the gain of the antenna is increased.

Additionally, it is preferable that, in at least two adjacent resonance sections, coil axes of the respective coil sections are aligned on a straight line; and the planes that substantially contain the opening sections of adjacent coil sections are oriented at right angles to each other. By adopting this structure, the two coil sections are aligned on the same straight line so that the mounting area of the antenna is reduced, and because the direction of the magnetic field for a maximum magnetic flux through the one coil is perpendicular to the direction of the magnetic field for a maximum magnetic flux through the other coil, antenna gain is effective for both the vertically and horizontally polarized signal waves.

To summarize the features of the present invention, the following beneficial effects are noted.

As explained above, according to the present invention, the antenna has a resonance section having an inductance section and a capacitance section connected electrically in parallel, and the inductance section has a coil section, and at least one of the openings provided at both ends of the coil section is contained in a plane oriented at an angle to the coil axis so that the inductance value of the coil section is increased, and the antenna gain can be increased without unduly increasing the total length of the antenna.

Also, according to the present invention, the portion that circles the coil axis of the conductor is provided parallel to the opening section that is substantially contained in a plane oriented at an angle to the coil axis so that the value of inductance of the coil section is further increased, and the antenna gain can be increased without unduly increasing the total length of the antenna.

Also, according to the present invention, because the antenna is constructed of a plurality of resonance sections connected electrically in series, the antenna gain can be increased.

Further, according to the present invention, because the antenna is constructed in such a way that a plurality of resonance sections are connected electrically in series by aligning the coil axes of the adjacent coil sections approximately on a straight line, and that the planes containing the opening sections of the adjacent coil sections are oriented at about the right angles to each other, the antenna gain for vertically polarized waves and horizontally polarized waves can be obtained using a small mounting area.

DESCRIPTION OF THE PREFERRED EMBODIMENTS

In the following, preferred embodiments of the present invention will be explained with reference to the drawings.

Figure 1:
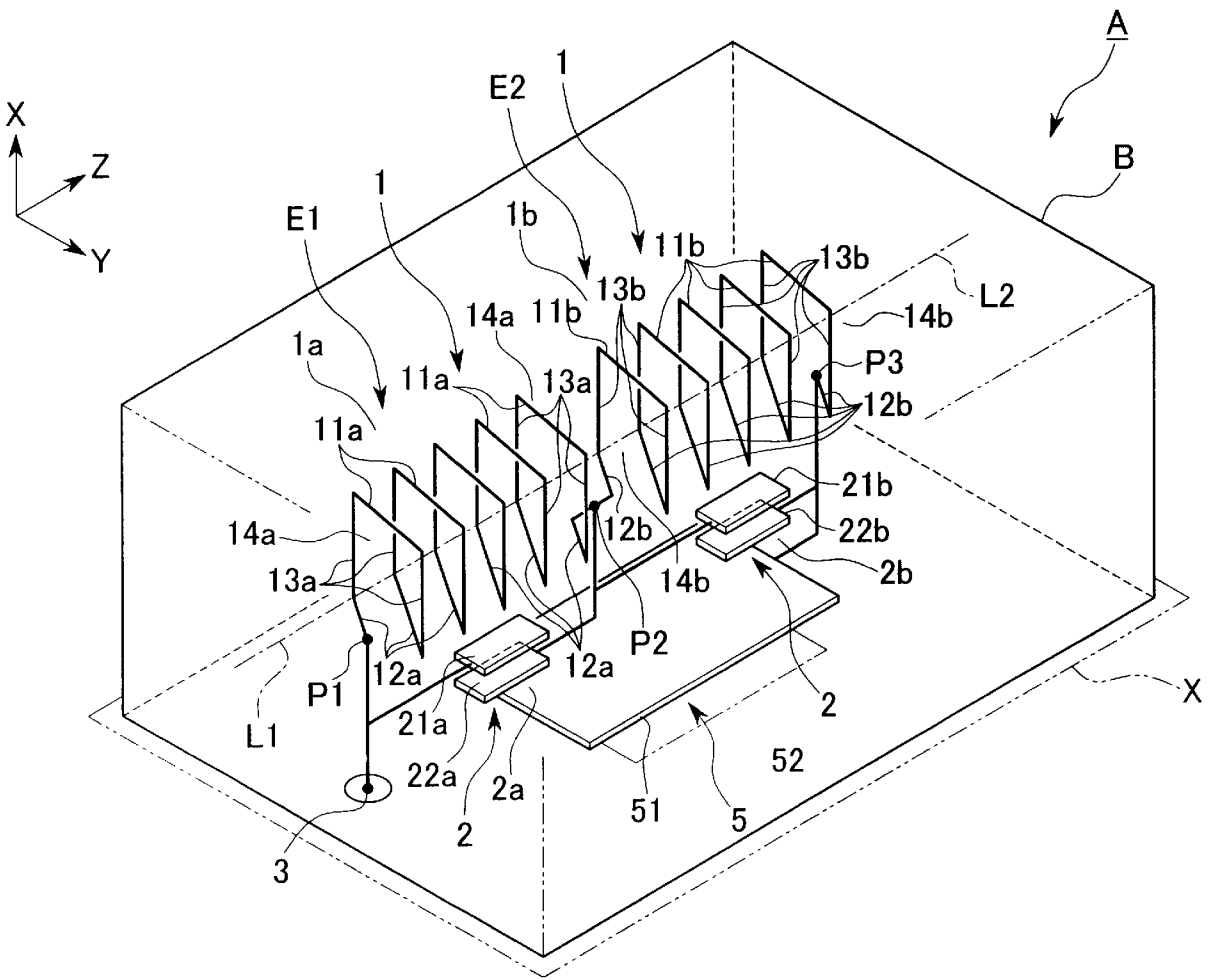
FIG. 1 is a perspective view of an example of the antenna in an embodiment of the present invention.
Figure 2:
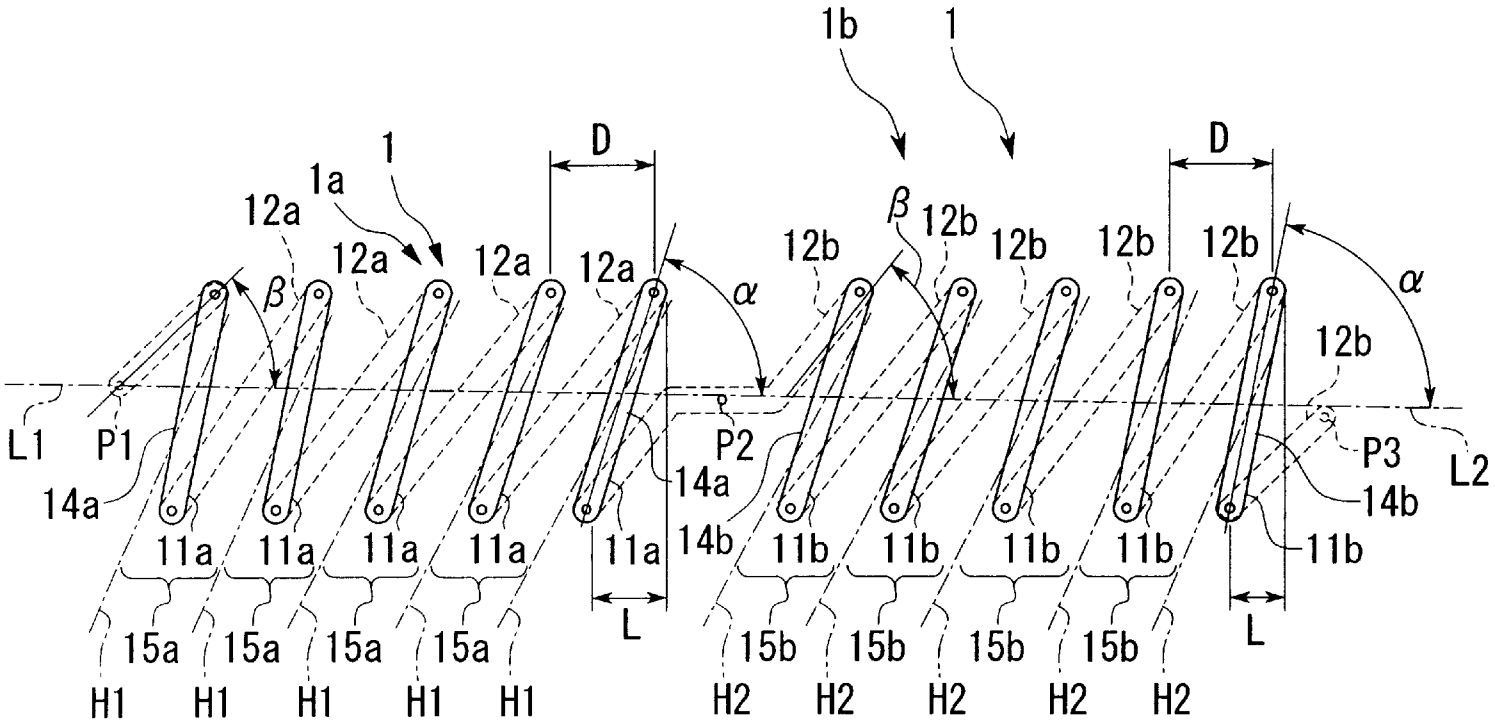
FIG. 2 is an enlarged view of the coil section and relates to a top view of the antenna shown in FIG. 1.
Figure 3:
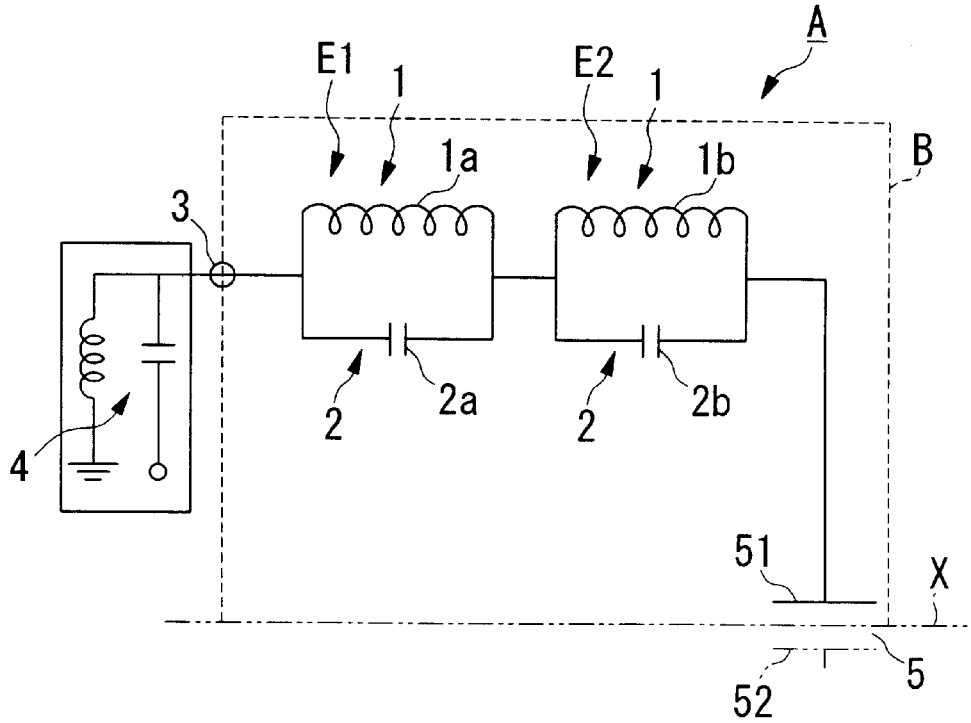
FIG. 3 is a diagram of an equivalent circuit of the antenna of the present invention.

FIGS. 1–3 show the antennas in an embodiment of the present invention. In the diagrams, antenna A has two resonance sections E1, E2, and these resonance sections E1, E2 are electrically connected in series. Each of the antenna elements E1, E2 is comprised by an inductance section 1 and a capacitance section 2, which are connected in parallel. FIG. 3 shows an equivalent circuit of these connections.

One end P1 of the resonance section E1 is connected to the feed point 3 for supplying power to the resonance sections E1, E2. An impedance matching section 4 is connected externally to the feed point 3 to match the input impedance of the antenna.

Further, one end P3 of the resonance section E2 is connected in series to a frequency adjusting capacitance section 5.

The inductance section 1 has a coil section 1*a* or a coil section 1*b*. The coil section 1*a* is comprised by a conductor body resembling a square shaped spiral circling a coil axis L1, and this conductor body has parallel conductor patterns 11*a*, formed on the front surface of the substrate plate, which is not shown, and parallel conductor patterns 12*a* formed on the back surface of the substrate plate, and coil conductor sections 13*a* comprised by metal conductor filled in the through-holes punched through the substrate plate in the thickness direction, and electrically connecting the conductor patterns 11*a* and the conductor patterns 12*a*. Similarly, the coil section 1*b* is comprised by a conductor body resembling a square shaped spiral circling a coil axis L2, and this conductor body has parallel conductor patterns 11*b*, formed on the front surface of the substrate plate, and parallel conductor patterns 12*b* formed on the back surface of the substrate plate, and coil conductor sections 13*b* comprised by metal conductor filled in the through-holes punched through the substrate plate in the thickness direction, and electrically connecting the conductor patterns 11*b* and the conductor patterns 12*b*. The conductor body comprising the coil sections 1*a*, 1*b* is constructed so as to spiral in the same direction (clockwise direction in this embodiment) for a number of turns (five turns in this embodiment) about the coil axes L1, L2. More specifically, the coil section 1*a* is comprised by a conductor body formed by a turning section 15*a* that turns once around the coil axis L1 in the sequence of conductor pattern 11*a*, coil conductor section 13*a*, conductor pattern 12*a*, and coil conductor section 13*a*, and linking the turning section 15*a* in the direction of the coil axis L1. Similarly, the coil section 1*b* is comprised by a conductor body formed by a turning section 15*b* that turns once around the coil axis L2 in the sequence of conductor pattern 11*b*, coil conductor section 13*b*, conductor pattern 12*b*, and coil conductor section 13*b*, and linking the turning section 15*b* in the direction of the coil axis L2.

The coil sections 1*a,* 1*b* are connected so that the coil axes are substantially collinear through the junction point P2. Here, the value of the inductance section 1 thus formed in this embodiment is 69 nH at 1 MHz.

FIG. 2 is a top view of the antenna shown in FIG. 1, and represents an enlarged view of the coil sections 1*a,* 1*b* seen vertically in the direction of the coil axes L1, L2.

As shown in FIG. 2, the conductor patterns 11*a* are parallel to each other, and make an angle a with the axis L1, and conductor patterns 12*a* are parallel to each other, and make an angle β with the axis L1, which is slightly less than the angle α. The average value of the angles α, β, is selected to be near 45 degrees. Also, the conductor patterns 11*b* are parallel to each other, and make an angle α with the axis L2, and conductor patterns 12*b* are parallel to each other, and make an angle α with the axis L2, which is slightly less than the angle α. The average value of the angles α, β is selected to be near 45 degrees.

The coil section 1*a* is comprised by a conductor body formed by a plurality of the turning sections 15*a* (the portion that circles the axis once) which are linked in the direction of the axis L1. The turning section 15*a* circles the axis L1 once, starting from the center of the conductor pattern 11*a* and ending at the center of the conductor pattern 11*a,* in the order of conductor pattern 11*a,* coil conductor section 13*a,* conductor pattern 12*a,* coil conductor section 13*a,* and conductor pattern 11*a,* and the turning sections 15*a*. The angle a referred here is defined also as an angle that the turning section 15*a* makes with the axis L1. The conductor body is divided by planes H1 that are inclined at an angle to the axis L1 and oriented at right angles to the plane of the paper of FIG. 2, and traversing the center of the conductor pattern 11*a*. The turning sections 15*a* are formed in such a way that the turning sections 15*a* do not intersect the planes H1 except at the respective start point and the end point. That is, the turning sections 15*a* are included substantially in the inclined planes H1. Also, since the conductor patterns 11*a* are parallel to each other and the conductor pattern 12*a* are parallel to each other, the turning sections 15*a* are also formed parallel to each other. Because the turning sections 15*a* located at both ends of the conductor body form the opening sections 14*a,* the opening sections 14*a* are also included substantially in the inclined planes H1.

Similarly, the coil section 1*b* is comprised by a conductor body formed by a plurality of the turning sections 15*b* which are linked in the direction of the axis L2. The turning section 15*b* circles the axis L2 once, starting from the center of the conductor pattern 11*b* and ending at the center of the conductor pattern 11*b*, in the order of conductor pattern 11*b*, coil conductor section 13*b,* conductor pattern 12*b,* coil conductor section 13*b,* and conductor pattern 1*b*. The angle a referred here is defined also as an angle that the turning section 15*b* makes with the axis L2. The conductor body is divided by planes H2 that are inclined at an angle to the axis L1 and oriented at right angles to the plane of the paper of FIG. 2, and traversing the center of the conductor pattern 11*b*, and the turning sections 15*b* are formed in such a way that the turning sections 15*b* do not intersect the planes H2 except at the respective start point and the end point. That is, the turning sections 15*a* are included substantially in the inclined planes H2. Also, since the conductor patterns 11*b* are parallel to each other and the conductor pattern 12*b* are parallel to each other, the turning sections 15*b* are also formed parallel to each other. Because the turning sections 15*b* located at both ends of the conductor body form the opening sections 14*b,* the opening sections 14*b* are also included substantially in the inclined planes H2.

The capacitance section 2 has a condenser section 2*a* or 2*b*.

The condenser sections 2*a*, 2*b* are comprised by respective conductor patterns 21*a,* 21*b* having a roughly square shape formed on one surface of the substrate plate, which is not shown, and conductor patterns 22*a,* 22*b* having a roughly square shape formed on other surface of the substrate plate, that are oriented so that conductor patterns 21*a*, 21*b* and conductor patterns 22*a,* 22*b* are placed in opposition. Then, one conductor pattern 21*a* of the resonance section E1 is connected electrically to the feed point 3 while the other conductor pattern 22*a* is connected electrically to the junction point P2. And, one conductor pattern 21*b* of the resonance section E2 is connected electrically to the junction point P2 while the other conductor pattern 22*b* is connected electrically to the junction point P3. The capacitance value of the capacitance section 2 in this embodiment is 30 pF at 1 MHz.

Here, the substrate plate having the inductance sections 1 and the substrate plate having the capacitance sections 2 are laminated as a unit with an intervening insulation layer, not shown, comprised primarily of alumina.

The impedance matching section 4, for matching the input impedance of the antenna A connected to the feed point 3, is shown as an equivalent circuit in FIG. 3.

Also, an electrode 51 formed on a substrate plate is electrically connected to the junction point P3. The substrate plate on which the electrode 51 is formed is disposed so that the electrode 51 faces the inductance sections 1 as well as the capacitance sections 2, and is stacked in parallel to the substrate plate formed with the capacitance sections 2 so as to clamp the substrate plate, not shown, comprised primarily of alumina serving as the insulation layer. In this way, the antenna main body B is comprised into an unitized body.

The antenna A is constructed so that, by mounting the antenna main body B on a printed board X, the frequency adjusting capacitance section 5 connected in series electrically with the resonance section E2 is formed between the electrode 51 and the electrode 52 formed on the printed board X. That is, the antenna main body B is mounted on the printed board X so that the electrode 51 and the electrode 52 are opposite to each other and that the capacitance value is determined by the area of the electrodes 51, 52 or the nature of the material and the distance between the electrode plates.

The antenna A according to this embodiment is formed so that the resonance sections E1, E2, each of which has the inductance section 1 connected in parallel with the capacitance section 2 serves as a resonance section, and each resonance section serves as a resonance system for receiving the radio waves, and two such resonance systems are connected electrically in series so that the entire assembly as a whole provides a function of transmitting and receiving radio waves. Compared with a case of using only one resonance section, it is possible to increase the signal gain by arranging not less than two resonance sections in contradiction to the case of using one resonance section.

The opening sections 14*a* and 14*b,* when viewed from the top, are provided in such a way that they are inclined at an angle α essentially at 45 degrees with respect to the axes L1, L2, so that the opening area is increased 1.4 times compared with the case of having the angle α at right angles. Therefore, the magnetic flux penetrating through the opening sections 14*b,* is increased, and the inductance values of the coil sections 1*a,* 1*b* are increased.

By providing the opening section 14*a* and 14*b* at an angle, the lengths of the coils sections 1*a,* 1*b* are definitely increased by an amount L shown in the diagram. However, this length L is not as long as the values of the spacing D of the conductor patterns 11*a,* 11*b.* This means that, when the operational frequency is high and the spacing of the conductor spacing must be maintained at some distance, it is more effective to increase the opening area than to increase the number of windings of the coil sections 1*a,* 1*b* for increasing the inductance value without increasing the antenna length.

Further, for the coil sections 1*a,* 1*b* having a shape such that the spacing is relatively large in relation to the diameter of the coil, the turning sections 15*a,* 15*b* that form the conductor body can be seen to constitute individual loops. Accordingly, if the turning sections are provided at an angle to the coil axes L1, L2 such like as the opening sections 14*a,* 14*b,* the magnetic flux penetrating through the turning sections 15*a,* 15*b* is increased, and the inductance values of the coil sections 1*a,* 1*b* are increased.

Consequently, by increasing the inductance values of the coil sections 1*a,* 1*b,* the gain of the antenna A is increased.

The actual performance of the antenna was determined by preparing a copper-clad glass epoxy substrate plate of 300 mm square, removing the copper cladding from a corner to form an insulation region of 50×50 mm, and placing an antenna A having external dimensions of 26 mm length and 5 mm width and 2 mm thickness on the insulator region. A high frequency input cable was attached to the feed point side while performing impedance matching by using the impedance matching section 4 to give a matching impedance of 50Ω, and one end of the frequency adjusting capacitance section 5 on the terminating side is set to 2.5 pF. In this antenna, the maximum absolute gain of 1.90 $dB_i$ was obtained at the center frequency of 453 MHz.

On the other hand, by keeping other conditions the same, when the slant of the coil sections 1*a,* 1*b* was eliminated so that the angles α and β are essentially at right angles to the coil axes L1, L2, the maximum absolute gain was 1.12 $dB_i$.

As demonstrated above, by slanting the opening sections 14*a,* 14*b* at an angle to increase the magnetic flux penetrating through the opening sections 14*a,* 14*b,* it is possible to increase the gain of the antenna A.

Additionally, depending on the capacitance of the frequency adjusting capacitance section 5, the resonant frequency of the antenna A is altered, thereby enabling to adjust or change the frequency at which the maximum gain is obtained.

Also, by the action of the impedance matching section 4, the input impedance of the transmission path inclusive of the high frequency power source in the high frequency circuit to the feed point 3 is matched to the input impedance of the antenna A, and thus enabling to minimize the transmission loss.

As described above, according to this embodiment, the coil sections 1*a,* 1*b* of the resonance sections E1, E2, the opening sections 14*a,* 14*b,* and moreover, the turning section 15*a*, 15*b* that respectively constitute the conductor bodies are provided at an angle to the coil axes L1, L2, and are substantially included in the planes H1, H2 that are inclined to the coil axes L1, L2, so that the magnetic flux that penetrate through the conductor bodies is increased, thereby enabling to increase the inductance values of the coil sections 1*a,* 1*b,* with almost no change in the dimensions of the antenna A.

Here, it should be noted that the only one resonance section may be used in constructing the antenna. In this case also, the present circuit design can function as an antenna. In this case, it was found that for an antenna having only one resonance section, the maximum absolute gain was −6.05 $dB_i$ at the center frequency of 484 Mz.

Figure 4:
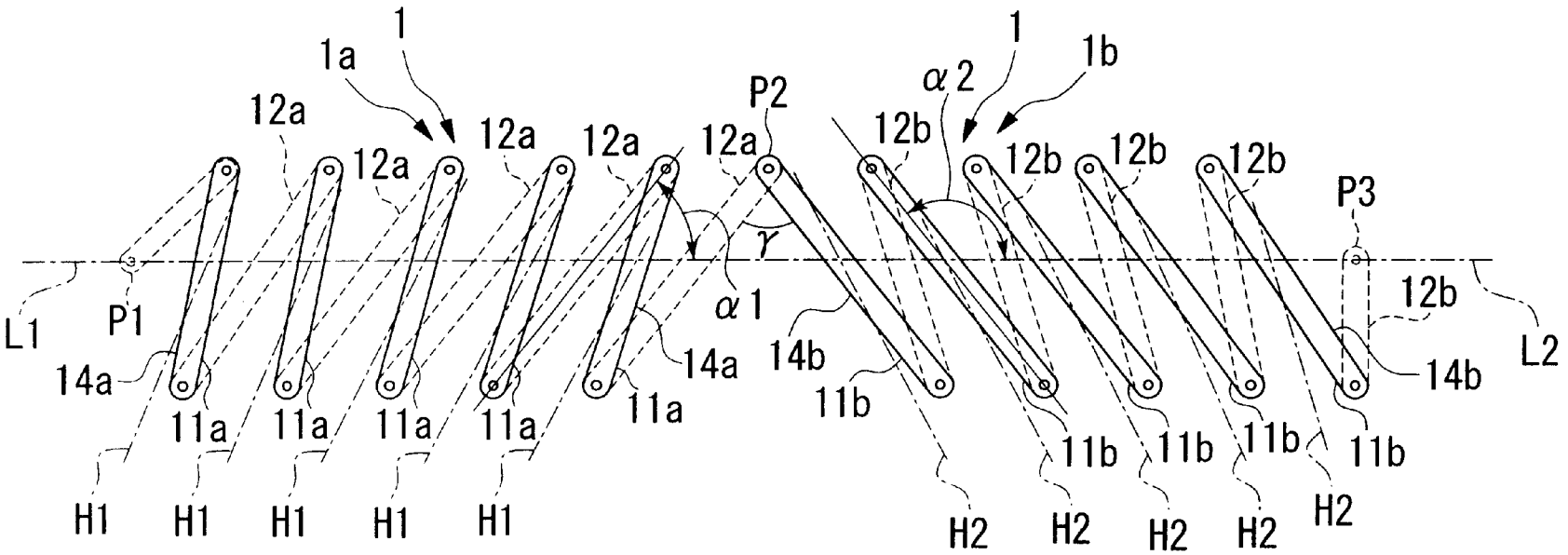
FIG. 4 is an enlarged view of another embodiment of the antenna of the present invention and relates to a top view of the antenna such like in FIG. 2.

Here, in the above embodiment, the shapes of the coil sections 1*a,* 1*b* are substantially the same, but, as shown in FIG. 4, it is permissible to orient the opening sections 14*a* and conductor patterns 12*a* at an angle al to the coil axis L1, viewing in the direction at right angles to the coil axes L1, L2 of the coil sections 1*a*, 1*b*, and to orient the opening sections 14*b* and conductor patterns 11*b* at an angle α2 different than angle α1 to the coil axis L2, such that the opening section 14*a* and the opening section 14*b* crosses each other at right angles to form an angle γ.

Figure 5:
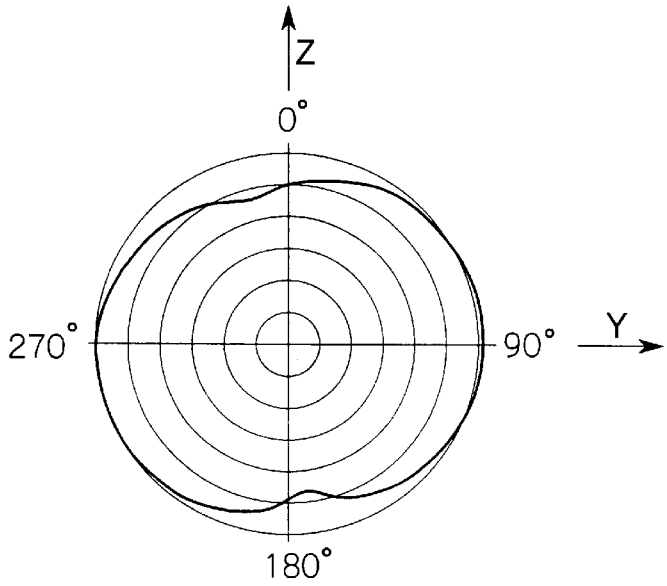
FIG. 5 is a diagram to show directivity of the antenna of the present invention.

According to such a structure, a uniform radiation pattern corresponding to the horizontally polarized waves and vertically polarized waves can be obtained. Therefor, there is no need to intersect the coil axes L1, L2 at right angles, so that the mounting area required for antenna A is reduced, and increase the convenience for its installation. FIG. 5 shows a power pattern of radiation within the plane Y-Z, and one can see that the radiation is virtually non-directive. In this arrangement, the maximum absolute gain of 1.63 $dB_i$ was obtained for the absolute gain, which is about 0.5 $dB_i$ higher than an arrangement in which no inclination is provided for the conductor bodies.

In this case, the gain shown in FIG. 5 was determined by preparing a copper-clad glass epoxy substrate plate of 300 mm square, and removing the copper cladding from a corner to form an insulation region of 50×150 mm, and placing an antenna A1 having external dimensions of 26 mm length and 5 mm width and 2 mm thickness on the insulator region. A high frequency input cable was attached to the feed point side while performing impedance matching by using the impedance matching section 4 to give a matching impedance of 50Ω, and one end of the frequency adjusting capacitance section 5 on the terminating side is set to 2.2 pF. In this antenna, the maximum absolute gain of 1.63 $dB_i$ was obtained at the center frequency of 478 MHz.

Additionally, it is permissible to provide a frequency adjusting capacitance section 5 as a separate member from the antenna main body B to construct an antenna structure so as to facilitate adjusting and changing the capacitance value. For example, it is possible to construct a structure that has an external separate condenser connected electrically in series. Further, an antenna module may be constructed such that it is comprised by an antenna main body and an externally-connected condenser section serving the function of the frequency adjusting capacitance section so that the condenser section may be freely detached from the antenna main body to enable easy switching of various condensers having different capacitance values, thereby improving its handling characteristics. Such a construction enables to more flexibly adjust the resonance frequency of the antenna.

Figure 6:
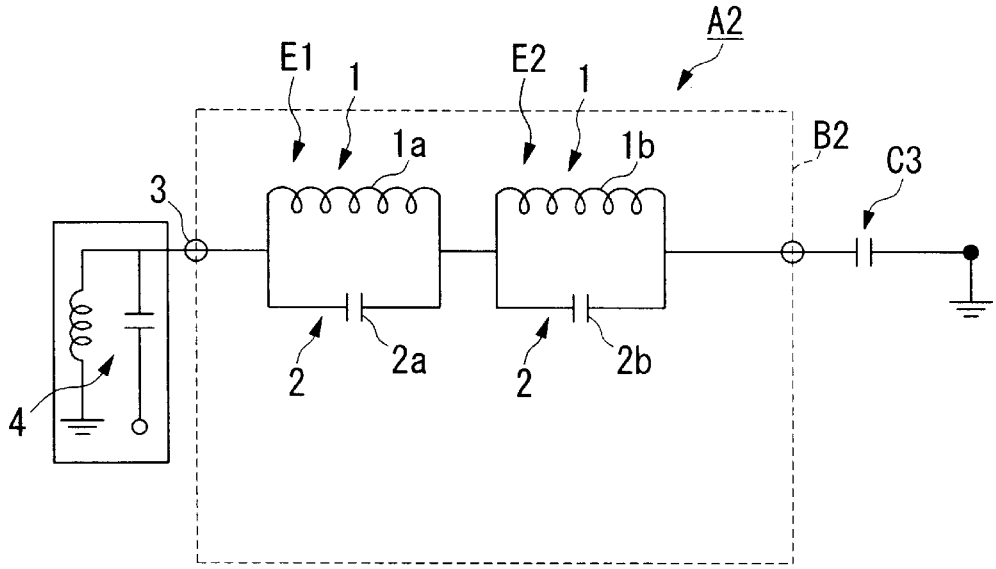
FIG. 6 is a diagram of an equivalent circuit of the another antenna of the present invention.

The antenna A2 shown in FIG. 6 is comprised primarily of an antenna main body B2, and the frequency adjusting capacitance section C3 for adjusting the center frequency of the antenna A2 is provided separately from the antenna main body B2 is connected electrically in series to the exterior of the antenna main body B2. The antenna gain was measured by preparing a copper-clad glass epoxy substrate plate of 300 mm square, and removing the copper cladding from a corner to form an insulation region of 50×50 mm, and placing an antenna A2, having the structure shown in FIG. 4 and having external dimensions of 26 mm length and 5 mm width and 2 mm thickness on the insulation region. A high frequency input cable was attached to the feed point side while using the impedance matching section 4 to match the input impedance at 50Ω. In this antenna structure, when the capacitance value of the frequency adjusting capacitance section C3 was set to 3.0 pF, a maximum absolute gain of 2.42 $dB_i$ was obtained at the center frequency of 428 MHz.

What is claimed is:

1. An antenna comprising a resonance section having an inductance section and a capacitance section connected electrically in parallel; wherein the inductance section has a coil section comprising a conductor formed in a spiral shape circling a coil axis or an angular shape circling the coil axis in a helical form, at least one opening section of opening sections formed at both ends of the coil section is contained in a plane oriented at an angle to the coil axis, and at least one turn of the coil section is substantially contained in a plane oriented at about said angle to the coil axis.

2. An antenna according to claim 1, wherein respective portions of the conductor that circle the coil axis are provided parallel to the opening section contained in the lane oriented at said an le to the coil axis.

3. An antenna according to claim 2, wherein the antenna has a plurality of resonance sections, and the resonance sections are connected electrically in series.

4. An antenna according to claim 3, wherein, in at least two adjacent resonance sections, coil axes of the respective coil sections are aligned on a straight line; and planes that substantially contain the opening sections of adjacent coil sections are oriented at right angles to each other.

5. An antenna according to claim 2, wherein said angle is about 45°.

6. An antenna according to claim 1, wherein each of the coil section is contained in a plane parallel with said plane oriented at about said angle to the coil axis.

7. An antenna according to claim 1, wherein said angle is about 45°.

8. An antenna according to claim 1, wherein said opening portions and said at least one turn of the coil section are contained in planes parallel to said plane oriented at said angle to the coil axis, so that a length of the coil section is increased by an amount that is less than a spacing between two consecutive turns of the coil section, and an increase of said length of the coil section produced by an inclination of said opening portions to the coil axis is smaller than an increase of said length by adding one extra turn to the coil section.

* * * * *